US008146660B2

(12) United States Patent
Irani et al.

(10) Patent No.: US 8,146,660 B2
(45) Date of Patent: Apr. 3, 2012

(54) COILED TUBING DEPLOYED SINGLE PHASE FLUID SAMPLING APPARATUS AND METHOD FOR USE OF SAME

(75) Inventors: Cyrus A. Irani, Houston, TX (US); Gian Franco Callarotti, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/029,350

(22) Filed: Feb. 17, 2011

(65) Prior Publication Data

US 2011/0139449 A1 Jun. 16, 2011

Related U.S. Application Data

(62) Division of application No. 12/270,140, filed on Nov. 13, 2008, now Pat. No. 7,967,067.

(51) Int. Cl.
*E21B 49/10* (2006.01)
*G01N 1/10* (2006.01)

(52) U.S. Cl. .... 166/264; 175/59; 73/152.23; 73/863.84; 73/863.86; 73/864.64

(58) Field of Classification Search ..... 166/264, 166/162, 163, 169; 175/59; 73/152.23, 863.81, 73/863.86, 863.84, 864.62–864.64
See application file for complete search history.

(56) References Cited

U.S. PATENT DOCUMENTS 3,611,799 A 10/1971 Davis
4,570,481 A 2/1986 McLaurin
4,665,983 A 5/1987 Ringgenberg
4,747,304 A 5/1988 King
4,787,447 A 11/1988 Christensen
4,878,538 A 11/1989 Christensen
4,883,123 A 11/1989 Zunkel et al.
4,903,765 A 2/1990 Zunkel
5,009,100 A 4/1991 Gruber et al.
5,058,674 A 10/1991 Schultz et al.
5,230,244 A 7/1993 Gilbert
5,240,072 A 8/1993 Schultz et al.
5,329,811 A 7/1994 Schultz et al.
5,368,100 A 11/1994 Lewandowski et al.

(Continued)

FOREIGN PATENT DOCUMENTS

EP 0534732 3/1993

(Continued)

OTHER PUBLICATIONS

Competitor Product Update, Schlumberger DST Sampling Systems—SCAR; (Undated but Admitted Prior Art).

(Continued)

*Primary Examiner* — Jennifer H Gay
(74) *Attorney, Agent, or Firm* — Lawrence R. Youst

(57) ABSTRACT

A coiled tubing deployed fluid sampler (50) for collecting a single phase fluid sample from a well. The fluid sampler (50) is actuated to establish fluid communication between an interior (56) and an exterior of the fluid sampler (50) such that a fluid sample is obtained from the well in a chamber (92) of the fluid sampler (50). The fluid pressure in the coiled tubing string is then increased, which pressurizes the fluid sample in the chamber (92). Thereafter, the coiled tubing and the fluid sampler (50) are retrieved to the surface with the pressurized fluid sample remaining above its saturation pressure during collection and retrieval to the surface.

19 Claims, 7 Drawing Sheets

U.S. PATENT DOCUMENTS

| | | | | |
|---|---|---|---|---|
| 5,540,280 | A | 7/1996 | Schultz et al. | |
| 5,687,791 | A | 11/1997 | Beck et al. | |
| 5,934,374 | A | 8/1999 | Hrametz et al. | |
| 6,065,355 | A | 5/2000 | Schultz | |
| 6,073,698 | A | 6/2000 | Schultz et al. | |
| 6,182,753 | B1 | 2/2001 | Schultz | |
| 6,182,757 | B1 | 2/2001 | Schultz | |
| 6,189,392 | B1 | 2/2001 | Schultz | |
| 6,192,984 | B1 | 2/2001 | Schultz | |
| 6,301,959 | B1 | 10/2001 | Hrametz et al. | |
| 6,439,307 | B1 | 8/2002 | Reinhardt | |
| 6,491,104 | B1 | 12/2002 | Wilie et al. | |
| 6,622,554 | B2 | 9/2003 | Manke et al. | |
| 6,668,924 | B2 | 12/2003 | Bolze et al. | |
| 6,722,194 | B2 | 4/2004 | Manke et al. | |
| 6,745,835 | B2 * | 6/2004 | Fields | 166/264 |
| 6,748,843 | B1 | 6/2004 | Barker et al. | |
| 6,907,797 | B2 | 6/2005 | DiFoggio | |
| 7,083,009 | B2 | 8/2006 | Paluch et al. | |
| 7,090,012 | B2 | 8/2006 | Hill et al. | |
| 7,128,144 | B2 | 10/2006 | Fox et al. | |
| 7,140,436 | B2 | 11/2006 | Grant et al. | |
| 7,197,923 | B1 | 4/2007 | Wright et al. | |
| 7,246,664 | B2 | 7/2007 | Shammai et al. | |
| 7,258,167 | B2 | 8/2007 | Shammai et al. | |
| 7,380,599 | B2 | 6/2008 | Fields et al. | |
| 7,395,712 | B2 | 7/2008 | Irani et al. | |
| 7,428,925 | B2 | 9/2008 | Brown et al. | |
| 7,430,965 | B2 | 10/2008 | Walker | |
| 7,472,589 | B2 | 1/2009 | Irani et al. | |
| 7,596,995 | B2 * | 10/2009 | Irani et al. | 73/152.23 |
| 7,621,325 | B2 | 11/2009 | Shammai et al. | |
| 7,673,506 | B2 * | 3/2010 | Irani et al. | 73/152.23 |
| 7,762,130 | B2 * | 7/2010 | Irani et al. | 73/152.23 |
| 7,856,872 | B2 * | 12/2010 | Irani et al. | 73/152.23 |
| 7,874,206 | B2 * | 1/2011 | Irani et al. | 73/152.23 |
| 7,926,342 | B2 * | 4/2011 | Irani et al. | 73/152.23 |
| 7,946,166 | B2 * | 5/2011 | Irani et al. | 73/152.23 |
| 7,950,277 | B2 * | 5/2011 | Irani et al. | 73/152.23 |
| 7,966,876 | B2 * | 6/2011 | Irani et al. | 73/152.23 |
| 7,967,067 | B2 * | 6/2011 | Irani et al. | 166/264 |
| 2004/0003657 | A1 | 1/2004 | Manke et al. | |
| 2004/0020649 | A1 * | 2/2004 | Fields | 166/264 |
| 2005/0183610 | A1 | 8/2005 | Barton et al. | |
| 2005/0205301 | A1 | 9/2005 | Irani et al. | |
| 2007/0101808 | A1 * | 5/2007 | Irani et al. | 73/152.23 |
| 2008/0148838 | A1 * | 6/2008 | Irani et al. | 73/152.23 |
| 2008/0257031 | A1 * | 10/2008 | Irani et al. | 73/152.28 |
| 2009/0241657 | A1 * | 10/2009 | Irani et al. | 73/152.23 |
| 2009/0241658 | A1 * | 10/2009 | Irani et al. | 73/152.23 |
| 2009/0288824 | A1 * | 11/2009 | Fowler et al. | 166/250.17 |
| 2009/0293606 | A1 * | 12/2009 | Irani et al. | 73/152.28 |
| 2009/0301184 | A1 * | 12/2009 | Irani et al. | 73/152.28 |
| 2011/0132601 | A1 * | 6/2011 | Pettinato et al. | 166/254.1 |

FOREIGN PATENT DOCUMENTS

| | | |
|---|---|---|
| GB | 2348222 | 9/2000 |
| WO | 0163093 | 8/2001 |
| WO | 2004099564 | 11/2004 |

OTHER PUBLICATIONS

Schlumberger, "PVT Express, Accurate, mobile fluid analysis service"; (Oct. 2005).

Schlumberger, "MDT Single-phase sampling"; (2006).

OTC 18201, "Advances in Fluid Sampling with Formation Testers for Offshore Exploration"; (2006).

Schlumberger MDT drawing, "Single Phase Multisample Chamber"; (Undated but Admitted Prior Art).

EP International Search Report dated Aug. 29, 2007, International Application No. 07252099.2-1266; (Aug. 29, 2007).

* cited by examiner

COILED TUBING DEPLOYED SINGLE PHASE FLUID SAMPLING APPARATUS AND METHOD FOR USE OF SAME

CROSS-REFERENCE TO RELATED APPLICATIONS

This is a divisional of co-pending application Ser. No. 12/270,140, filed Nov. 13, 2008.

TECHNICAL FIELD OF THE INVENTION

This invention relates, in general, to testing and evaluation of subterranean formation fluids and, in particular, to a coiled tubing deployed single phase fluid sampling apparatus for obtaining one or more fluid samples and maintaining the samples above their saturation pressure during capture and retrieval from the wellbore.

BACKGROUND OF THE INVENTION

Without limiting the scope of the present invention, its background is described with reference to testing hydrocarbon formations, as an example.

It is well known in the subterranean well drilling and completion art to perform tests on formations intersected by a wellbore. Such tests are typically performed in order to determine geological or other physical properties of the formation and fluids contained therein. For example, parameters such as permeability, porosity, fluid resistivity, temperature, pressure and bubble point may be determined. These and other characteristics of the formation and fluid contained therein may be determined by performing tests on the formation before the well is completed.

One type of testing procedure that is commonly performed is to obtain a fluid sample from the formation to, among other things, determine the composition of the formation fluids. In this procedure, it is important to obtain a sample of the formation fluid that is representative of the fluids as they exist in the formation. In a typical sampling procedure, a sample of the formation fluids may be obtained by lowering a sampling tool having a sampling chamber into the wellbore on a conveyance such as a wireline, slick line, coiled tubing, jointed tubing or the like. When the sampling tool reaches the desired depth, one or more ports are opened to allow collection of the formation fluids. The ports may be actuated in a variety of ways such as by electrical, hydraulic or mechanical methods. Once the ports are opened, formation fluids travel through the ports and a sample of the formation fluids is collected within the sampling chamber of the sampling tool. After the sample has been collected, the sampling tool may be withdrawn from the wellbore so that the formation fluid sample may be analyzed.

It has been found, however, that during the capture of the fluid sample, the pressure on the fluid samples may be significantly reduced. In addition, it has been found that as the fluid sample is retrieved to the surface, the temperature of the fluid sample decreases causing shrinkage of the fluid sample and a further reduction in the pressure of the fluid sample. These changes can cause the fluid sample to approach or reach saturation pressure creating the possibility of flashing of lighter components present in the fluid sample and subsequent asphaltene deposition. Once such a process occurs, the resulting fluid sample is no longer representative of the fluids present in the formation. Therefore, a need has arisen for an apparatus and method for obtaining a fluid sample from a formation and retrieving the fluid sample from the wellbore without degradation of the fluid sample.

SUMMARY OF THE INVENTION

The present invention disclosed herein provides a fluid sampler and a method for obtaining fluid samples from a well without the occurrence of phase change degradation of the fluid samples during the collection of the fluid samples or retrieval of the fluid samples from the wellbore.

In one aspect, the present invention is directed to a coiled tubing deployed fluid sampling apparatus for collecting a single phase fluid sample from a well. The apparatus includes a coiled tubing string having a tubing bore and a housing connected to the coiled tubing string that includes an opening. An actuator is disposed within the housing. The actuator is operable to establish fluid communication between the interior and the exterior of the housing through the opening. A first one-way valve that is disposed within the housing defines a first end of a sample fluid chamber. A first floating piston that is disposed within the housing defines a second end of the sample fluid chamber and a first end of a metering fluid chamber. A second floating piston that is disposed within the housing defines a second end of the metering fluid chamber and a first end of a charging chamber. A second one-way valve that is disposed within the housing defines a second end of the charging chamber. A restrictor is disposed within the housing between the first and second floating pistons.

In one embodiment, upon the actuator establishing fluid communication between the interior and the exterior of the housing through the opening, a fluid sample from the well enters the sample fluid chamber. The fluid sample passes through the first one-way valve and acts on the first floating piston to expand the sample fluid chamber. In this embodiment, a metering fluid in the metering fluid chamber passes through the restrictor in response to the fluid sample acting on the first floating piston. The metering fluid controls the rate of expansion of the sample fluid chamber and acts on the second floating piston to contract the charging chamber. Upon completing the capture of the fluid sample in the sample fluid chamber, fluid pressure in the tubing bore of the coiled tubing string is increased such that the fluid pressure passes through the second one-way valve and acts on the second floating piston to expand the charging chamber and force metering fluid through the restrictor. The metering fluid then acts on the first floating piston to contract the sample fluid chamber, thereby pressurizing the fluid sample in the sample fluid chamber.

In another aspect, the present invention is directed to a method of collecting a single phase fluid sample from a well. The method includes running a fluid sampler into the well on a coiled tubing string, actuating the fluid sampler to establish fluid communication between an interior and an exterior of the fluid sampler, obtaining a fluid sample from the well in a chamber of the fluid sampler, increasing fluid pressure in the coiled tubing string, pressurizing the fluid sample in the chamber in response to increasing fluid pressure in the coiled tubing string and retrieving the coiled tubing and the fluid sampler containing the fluid sample from the well.

In the method, actuating the fluid sampler may include operating a mechanical clock, sending a signal to a telemetry receiver and/or shifting a sliding sleeve. Also, obtaining a fluid sample may include flowing the fluid sample through a one-way valve in the fluid sampler, shifting a floating piston, passing a metering fluid through a restrictor and/or expanding the chamber. Further, pressurizing the fluid sample may include communicating fluid pressure from the coiled tubing string through a one-way valve in the fluid sampler. Likewise, retrieving the coiled tubing and the fluid sampler may include repressurizing the fluid sample in the chamber in response to increasing fluid pressure in the coiled tubing string.

In a further aspect, the present invention is directed to a method of collecting a single phase fluid sample from a well. The method includes running a fluid sampler into the well on a coiled tubing string, actuating the fluid sampler to establish fluid communication between an interior and an exterior of the fluid sampler, obtaining a fluid sample from the well in a chamber of the fluid sampler, maintaining the pressure of the fluid sample above its saturation pressure during the obtaining step, increasing fluid pressure in the coiled tubing string, pressurizing the fluid sample in the chamber in response to increasing fluid pressure in the coiled tubing string, retrieving the coiled tubing and the fluid sampler containing the fluid sample from the well and maintaining the pressure of the fluid sample above its saturation pressure during the retrieving step.

In the method, maintaining the pressure of the fluid sample above its saturation pressure during the obtaining step may include controlling expansion of the chamber using a metering fluid passing through a restrictor. Similarly, maintaining the pressure of the fluid sample above its saturation pressure during the retrieving step may include repressurizing the fluid sample in the chamber in response to increasing fluid pressure in the coiled tubing string.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
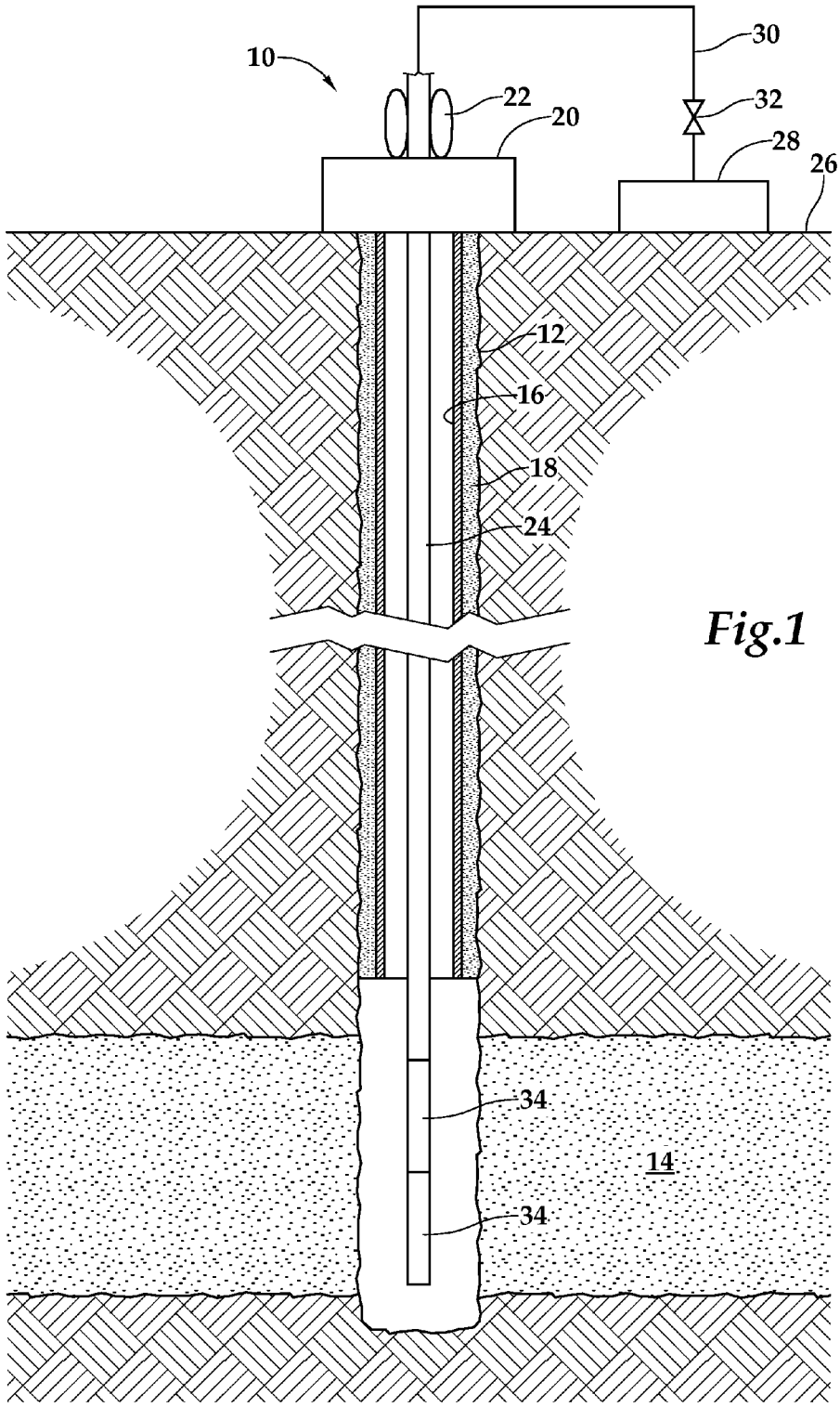
FIG. 1 is a schematic illustration of a fluid sampler deployed in a wellbore on coiled tubing string that embodies principles of the present invention.

Referring initially to FIG. 1, a typical well having a pair of coiled tubing deployed fluid samplers positioned therein is schematically illustrated and generally designated 10. Well 10 is constructed by drilling a borehole 12 that intersects a subterranean hydrocarbon bearing formation 14 from which oil or gas is to be produced. In the illustrated embodiment, the portion of borehole 12 that intersects formation 14 is uncased or open hole, however, this portion of borehole 12 could alternatively be cased. An upper portion of borehole 12 includes casing 16 that is cemented in place with cement 18. The upper end of well 10 is closed by a conventional wellhead assembly 20. Coiled tubing injectors 22 are used to pass a coiled tubing string 24 from a conventional coiled tubing reel (not shown) down through wellhead 20 into well 10. As used herein the term coiled tubing will include any continuous or endless pipe string that may be wound on a spool or otherwise deployed rapidly including continuous metal tubulars such as low-alloy carbon-steel tubulars, composite coiled tubulars, capillary tubulars and the like.

Located on the earth's surface 26 at a location adjacent wellhead assembly 20 is a source of pressurized fluid 28 which is in communication with coiled tubing string 24 through a pressure supply line 30 having a valve or other controller associated therewith. It will be understood that pressure supply conduit 30 will be connected to the coiled tubing reel (not shown) in a conventional manner so as to supply fluid pressure to a tubing bore within coiled tubing string 24.

Positioned on the lower end of coiled tubing string 24 is a pair of fluid samplers 34. It will be understood that other tools could be run on coiled tubing string 24 in addition to fluid samplers 34 such as centralizers or packers to assist in positioning fluid samplers 34 or providing isolation within borehole 12 as desired.

Even though well 10 is depicted as a vertical well, it should be noted by those skilled in the art that the fluid samplers of the present invention is equally well-suited for use in deviated wells, inclined wells and horizontal wells. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. In addition, it should be noted that certain aspects of the present invention are particularly useful in taking a sample of fluids being produced into a horizontal portion of a well. For example, use of coiled tubing string 24 to run fluid samplers 34 into a horizontal portion of a well provides accurate and easy placement of fluid samplers 34 at any desired location along a horizontal borehole. This cannot be accomplished with wireline conveyed tools which depend on gravity as a motive force and which cannot be moved by the wireline any substantial distance into a horizontal well.

Figure 2A:
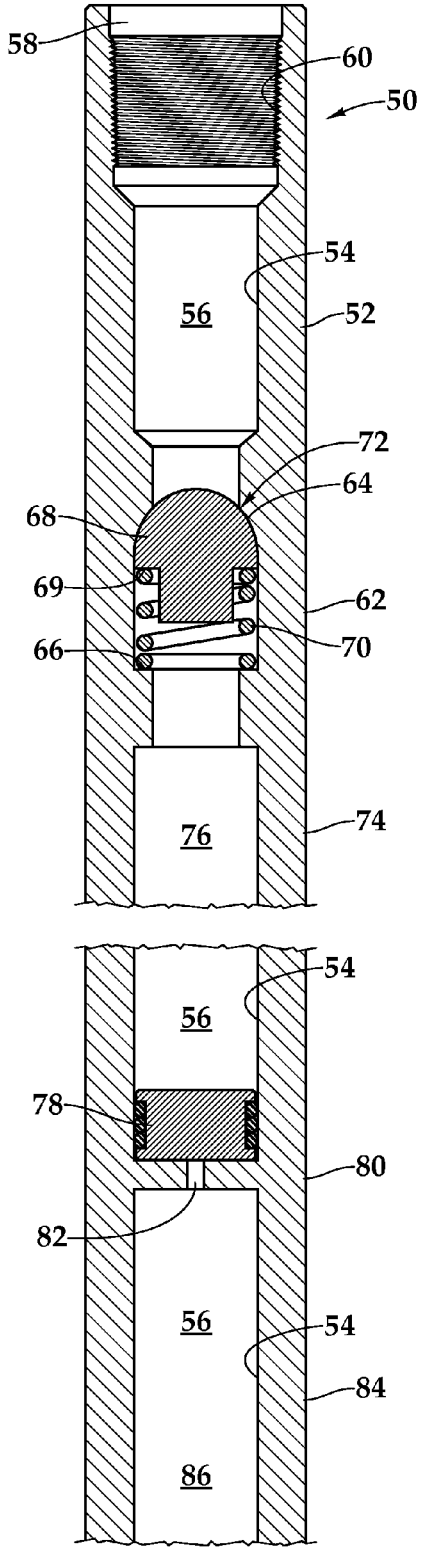
FIGS. 2A-2B are cross-sectional views of one embodiment of a fluid sampler embodying principles of the present invention in its running position.
Figure 2B:
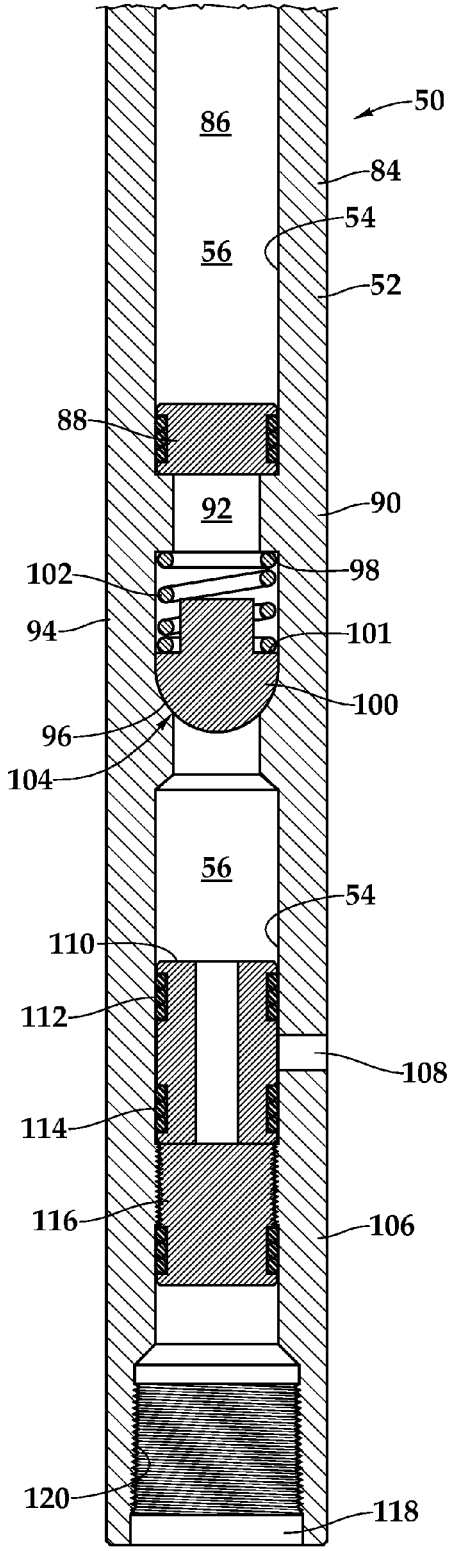

Referring now to FIGS. 2A-2B, a fluid sampler that embodies principles of the present invention is representatively illustrated and generally designated 50. Fluid sampler 50 is depicted in its initial or running configuration. Fluid sampler 50 includes an outer housing 52. In the illustrated embodiment, outer housing 52 is depicted as a single housing member, however, it will be understood by those skilled in the art that outer housing 52 could alternatively be made up of any number of tubular sections threadedly connected together with appropriate seals therebetween.

Fluid sampler 50 has a bore 54 that defines an interior central housing passage 56 that extends longitudinally through fluid sampler 50 includes numerous sections that enable fluid sampler 50 to operate according to the present invention. The uppermost section of outer housing 52 has an open end 58 including internal threads 60 defined therein for connection of fluid sampler 50 to coiled tubing string 24, a similar fluid sampler or other tool in a conventional manner. When coiled tubing string 24 is connected to fluid sampler 50, the tubing bore of coiled tubing string 24 will be in fluid communication with interior passage 56 of fluid sampler 50.

Outer housing 52 includes an upper valve housing section 62. Upper valve housing section 62 has a valve seat 64 and an upwardly facing shoulder 66. Disposed within central housing passage 56 and upper valve housing section 62 is a valve element 68 having a downwardly facing shoulder 69. A biasing element depicted as a spiral wound compression spring 70 is positioned between upwardly facing shoulder 66 and downwardly facing shoulder 69. In this configuration, spring 70 biases valve element 68 against valve seat 64 which prevents fluid flow upwardly through upper valve housing section 62, however, differential pressure of a predetermined magnitude sufficient to overcome the spring force of spring 70 shifts valve element off valve seat 64, which allows fluid flow downwardly through upper valve housing section 62. As such, valve seat 64, valve element 68 and spring 70 operate as a one-way valve and may be referred to collectively as check valve 72.

Below upper valve housing section 62, outer housing 52 includes an atmospheric and charging housing section 74. The portion of central housing passage 56 disposed within atmospheric and charging housing section 74 is also referred to herein as atmospheric and charging chamber 76. As described in greater detail below, atmospheric and charging chamber 76 initially contains a compressible fluid such as nitrogen or air at a low pressure such as atmospheric pressure. Following the capture of a fluid sample in fluid sampler 50, atmospheric and charging chamber 76 is charged with a high pressure compressible fluid such as high pressure nitrogen from pressure source 28 via the tubing bore of coiled tubing string 24. Defining the lower end of atmospheric and charging chamber 76 is an optional floating piston 78. Floating piston 78 is slidingly and sealable disposed within bore 54 of housing 52 and is operable to shift upwardly and downwardly in response to changes in differential pressure thereacross as described below.

Figure 7:
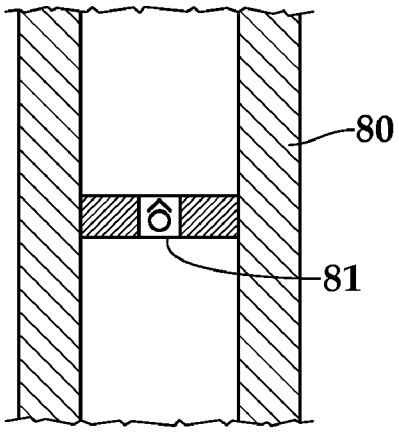
FIG. 7 is cross-sectional view a flow restrictor section of one embodiment of a fluid sampler embodying principles of the present invention.
Figure 8:
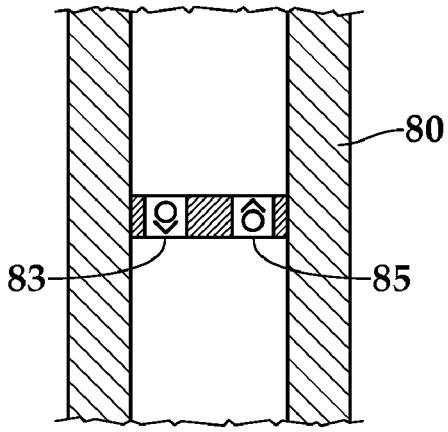
FIG. 8 is cross-sectional view a flow restrictor section of another embodiment of a fluid sampler embodying principles of the present invention.

Outer housing 52 includes a flow restrictor housing section 80. Positioned within central housing passage 56 and flow restrictor housing section 80 is a flow restricting device depicted as orifice 82. Even though orifice 82 is depicted as being integral with flow restrictor housing section 80, it will be understood by those skilled in the art that any type of flow restricting device suitable for metering fluids as described below could alternatively be used. For example, as best seen in FIG. 7, a flow restrictor including valve 81 may be positioned in flow restrictor housing section 80 to provide greater restriction to flow of a metering fluid in the upward direction as compared to the downward direction. Likewise, as best seen in FIG. 8, a flow restrictor including a pair of check valves 83 and 85 may be positioned in flow restrictor housing section 80 wherein check valve 85 prevents fluid flow in the upward direction while check valve 83 prevents fluid flow in the downward direction. In this embodiment, check valve 83 provides a greater restriction to flow of a metering fluid in the upward direction than does check valve 85 in the downward direction. Also, in certain embodiments, such as those not including floating piston 78, a optional rupture disk or other pressure actuated relief device may be disposed within flow restrictor housing section 80 to prevent initial movement of fluid through flow restrictor housing section 80.

Below flow restrictor housing section 80, outer housing 52 includes a metering fluid housing section 84. The portion of central housing passage 56 disposed within metering fluid housing section 84 is also referred to herein as a metering fluid chamber 86. As described in greater detail below, metering fluid chamber 86 initially contains a noncompressible metering fluid such as a hydraulic fluid, silicone oil or the like at a low pressure such as atmospheric pressure. Defining the lower end of metering fluid chamber 86 is a floating piston 88. Floating piston 88 is slidingly and sealable disposed within bore 54 of housing 52 and is operable to shift upwardly and downwardly in response to changes in differential pressure thereacross as described below. Likewise, the upper end of metering fluid chamber 86 is defined by floating piston 78 that is operable to shift upwardly and downwardly in response to changes in differential pressure thereacross as described below.

Below metering fluid housing section 84, outer housing 52 includes a sample fluid housing section 90. The portion of central housing passage 56 disposed within sample fluid housing section 90 is also referred to herein as a sample fluid chamber 92. As described in greater detail below, sample fluid chamber 92 is initially evacuated or contains a compressible fluid such as nitrogen or air at a low pressure such as atmospheric pressure. Following the capture of a fluid sample in fluid sampler 50, sample fluid chamber 92 contains the fluid sample and maintains the fluid sample in a single phase. The upper end of sample fluid chamber 92 is defined by floating piston 88.

Outer housing 52 also includes a lower valve housing section 94. Lower valve housing section 94 has a valve seat 96 and a downwardly facing shoulder 98. Disposed within central housing passage 56 and lower valve housing section 94 is a valve element 100 having an upwardly facing shoulder 101. A biasing element depicted as a spiral wound compression spring 102 is positioned between downwardly facing shoulder 98 and upwardly facing shoulder 101. In this configuration, spring 102 biases valve element 100 against valve seat 96 which prevents fluid flow downwardly through lower valve housing section 94, however, differential pressure of a predetermined magnitude sufficient to overcome the spring force of spring 102 shifts valve element 100 off valve seat 96, which allows fluid flow upwardly through lower valve housing section 94. As such, valve seat 96, valve element 100 and spring 102 operate as a one-way valve and may be referred to collectively as check valve 104.

Below lower valve housing section 94, outer housing 52 includes a sample fluid entry housing section 106. Sample fluid entry housing section 106 includes one or more openings 108 that provide fluid communication between the exterior of fluid sampler 50 and central housing passage 56. The portion of central housing passage within fluid entry housing section 106 is preferably initially evacuated or may be filled with a compressible fluid such as nitrogen or air at a low pressure such as atmospheric pressure. Disposed within fluid entry housing section 106 and central housing passage 56 is a sliding sleeve 110. In the running position depicted in FIGS. 2A-2B, seals 112 and 114 straddle opening 108 and prevent fluid communication between the exterior of fluid sampler and central housing passage 56. Also disposed within fluid entry housing section 106 and central housing passage is an actuator 116 that is operable to shift sliding sleeve 110 such that seals 112 and 114 no longer straddle opening 108 to allow fluid communication between the exterior of fluid sampler 50 and central housing passage 56.

Actuator 116 may take many forms including a mechanical clock that may be set at the surface such that after a particular amount of time it shifts sliding sleeve 110. Alternatively, actuator 116 may be operated by other mechanical, electrical, hydraulic or similar methods as known to those skilled in the art. In addition, actuator 116 may include a receiver connected to a control module that initiates the shifting of sliding sleeve 110. The receiver may be any type of telemetry receiver, such as a receiver capable of receiving acoustic signals, pressure pulse signals, electromagnetic signals, mechanical signals or the like. As such, any type of telemetry may be used to transmit signals to the receiver to initiate the movement of sliding sleeve 100.

Alternatively, instead of using sliding sleeve 110 and actuator 116, a rupture disk or other pressure relief device may be installed within opening 108 or within central housing passage 56 which operates to prevent and selectively allow fluid communication between the exterior of fluid sampler 50 and central housing passage 56. In this case, when it is desired to receive a fluid sample into fluid sampler 50, pressure in the annulus surrounding fluid sampler 50 is increased a sufficient amount to rupture the disk, thereby permitting the desired fluid communication.

The lowermost section of outer housing 52 has an open end 118 including internal threads 120 defined therein for connection of fluid sampler 50 to another tool either similar to or different from fluid sampler 50 or to receive a plug therein. When fluid sampler 50 is connected to a similar fluid sampler, interior passage 56 of fluid sampler 50 will be in fluid communication with a similar interior passage of the similar fluid sampler.

The operation of fluid sampler 50 will now be described with reference to FIGS. 2A-2B, FIGS. 3A-3B and FIGS. 4A-4B. Prior to connection to coiled tubing string 24, fluid sampler 50 is redressed such that it is in its running configuration, as best seen in FIG. 2A-2B. In this configuration, atmospheric and charging chamber 76 contains a compressible fluid such as nitrogen or air at a low pressure such as atmospheric pressure, metering fluid chamber 86 contains a noncompressible metering fluid such as a hydraulic fluid, silicone oil or the like at a low pressure such as atmospheric pressure and the portion of central housing passage 56 within fluid entry housing section 106 and sample fluid chamber 92 are preferably evacuated or filled with a compressible fluid such as nitrogen or air at a low pressure such as atmospheric pressure. The upper end of fluid sampler 50 is then coupled to the lower end of coiled tubing string 24 and the lower end of fluid sampler 50 may be coupled to another fluid sampler, another tool or be capped off.

Figure 3A:
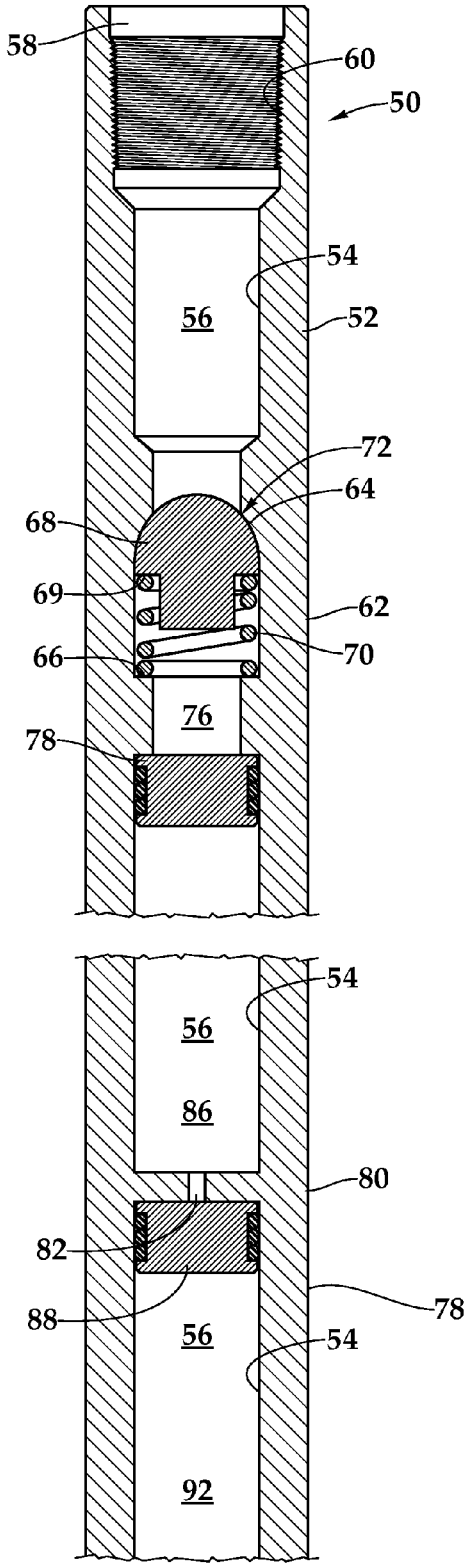
FIGS. 3A-3B are cross-sectional views of one embodiment of a fluid sampler embodying principles of the present invention in its sampling position.
Figure 3B:
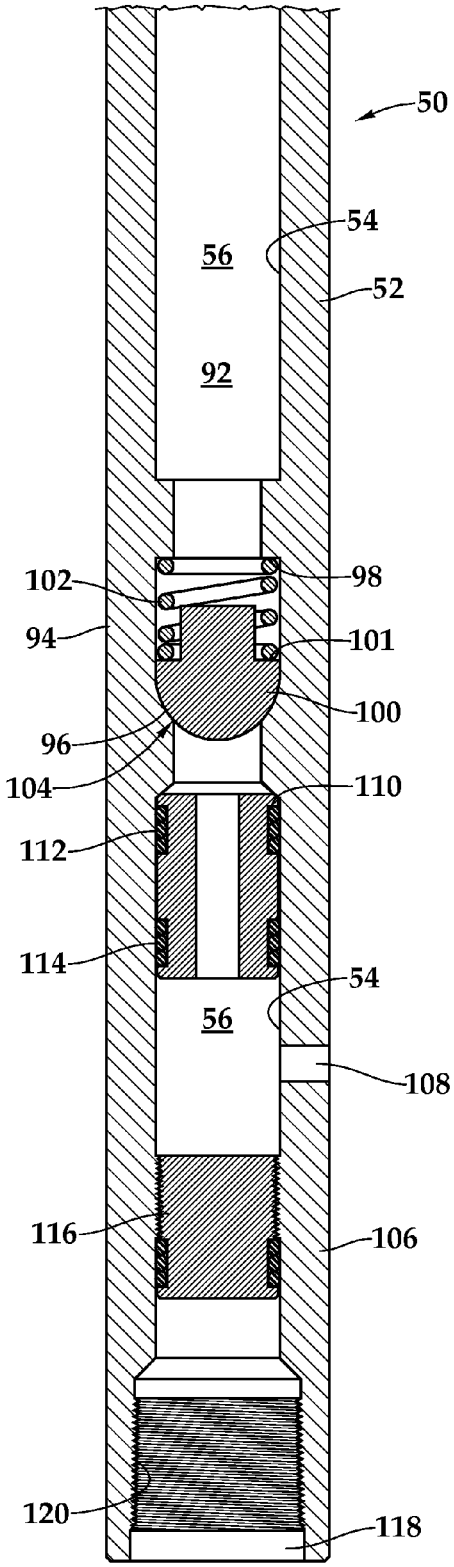

Fluid sampler 50 is then run downhole on coiled tubing string 24 to the desired location where the fluid sample or samples will be taken. Once at the target location, as best seen in FIG. 1, actuator 116 operates sliding sleeve 110 to allow fluid communication between the exterior of fluid sampler 50 and central housing passage 56 via opening 108, as best seen in FIG. 3B. Actuator 116 may be operated by any known means including mechanical, electrical or hydraulic triggering. Once fluid communication is established, high pressure formation fluids enter central housing passage 56 and are permitted to flow into sample fluid chamber 92 by shifting valve element 100 off valve seat 96. The formation fluids act against the lower side of floating piston 88 which causes floating piston 88 to move in the upward direction.

The velocity at which floating piston 88 moves through bore 54 is controlled by means of a metering fluid in metering fluid chamber 86 and the flow restriction provided in flow restrictor housing section such as orifice 82, valve 81 of FIG. 7 or valve 83 of FIG. 8. Specifically, the size and design of the flow restriction as well as the type and viscosity of the metering fluid are selected such that the sampling period, or the amount of time it take to fill sample fluid chamber 92 is predetermined such as five to ten minutes or up to thirty minutes or more as desired. By controlling the rate of movement of floating piston 88, the formation fluids entering fluid sampler 50 remain at or near reservoir pressure which prevents the fluid sample from dropping below its saturation pressure or otherwise degrading due to excessive pressure drop. As the metering fluid slowly passes through the flow restriction, both floating piston 88 and floating piston 78 move upwardly until they respectively shoulder out, as best seen in FIG. 3A. In this configuration, the entire sample has been obtained in sample fluid chamber 92 and is contained between the lower side of floating piston 88 and check valve 104. Likewise, the metering fluid is contained between the upper side of floating piston 88 and the lower side of floating piston 78. The compressible fluid in atmospheric and charging chamber 76 has been compressed between the upper side of floating piston 78 and check valve 72.

Figure 4A:
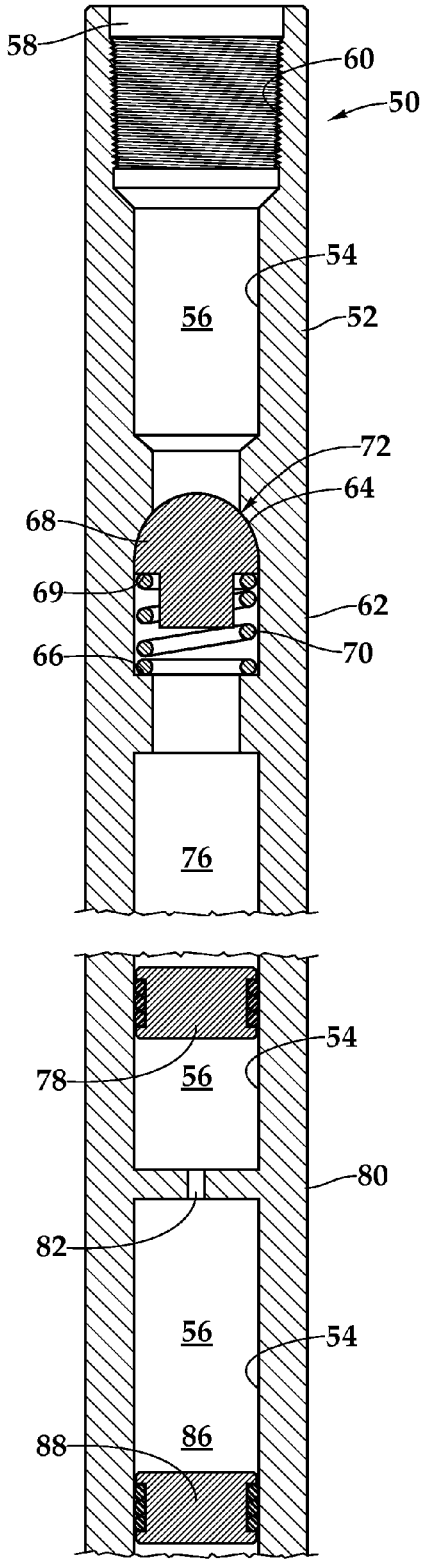
FIGS. 4A-4B are cross-sectional views of one embodiment of a fluid sampler embodying principles of the present invention in its charging position.
Figure 4B:
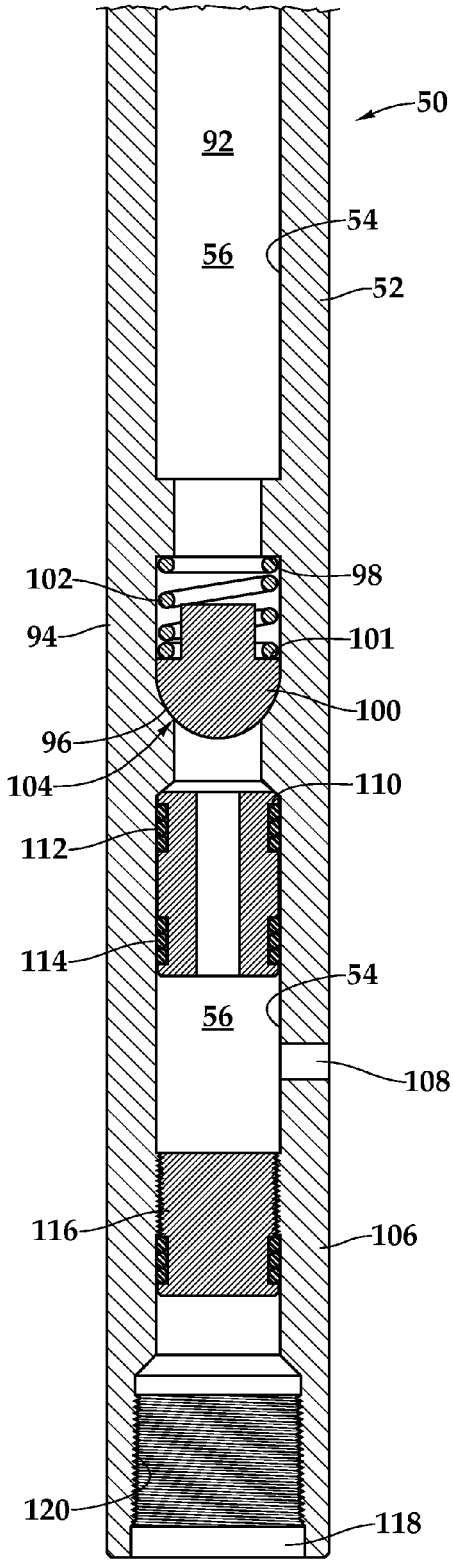

After it is determined that the desired fluid sample has been captured in sample fluid chamber 92, the present invention provides additional measures to preserve the fluid sample and prevent any degradation of the fluid sample due to the reduction in temperature and the associated reduction in pressure experienced within sample fluid chamber 92 as fluid sampler 50 is retrieved to the surface. Prior to retrieval, pressure source 28, as best seen in FIG. 1, is used to charge or pressurize the fluid sample contained within sample fluid chamber 92. Preferably, high pressure nitrogen is communicated to fluid sampler 50 via the tubing bore of coiled tubing string 24. The high pressure nitrogen acts on valve element 68 which shifts valve element 68 off seat allowing the high pressure nitrogen to pass downwardly through upper valve housing section 62. The high pressure nitrogen then acts on the upper side of floating piston 78 which forces the metering fluid back through the flow restriction, which in turn allows the metering fluid to act on the upper side of floating piston 88, as best seen in FIG. 4A. In the embodiments of the flow restriction depicted in FIGS. 7 and 8, the restriction to flow of the metering fluid through valves 81 and 85 is less in this direction to minimize the length of time of the charging process. As floating piston 88 shifts downwardly and as valve element 100 remains seated on valve seat 96, the fluid sample in sample fluid chamber 92 is pressurized, as best seen in FIG. 4B. Preferably, the fluid sample is pressurizes to a pressure above reservoir pressure and more preferably to a pressure between about 2,000 psi and about 7,000 psi above reservoir pressure. Those skilled in the art with understand that other pressures both higher and lower could alternatively be used, so long as the pressure does not exceed the pressure limits of coiled tubing string 24 and the pressure is maintained above the saturation pressure of the fluid sample.

Once the charging process in complete, the pressure above valve element 68 and within the tubing bore of coiled tubing string 24 may be bled off such that valve element 68 reseats on valve seat 64, trapping the higher pressure nitrogen in atmospheric and charging chamber 76. As fluid sampler 50 is retrieved to the surface, certain cooling of the fluid sample will take place. If it is believed that the initial charging of the fluid sample is not suitable to prevent phase change degradation along the entire trip, the retrieval process can be stopped at any time and from time to time to recharge the fluid sample by again pressurizing the tubing bore of coiled tubing string 24 with high pressure nitrogen at the desired pressure. Once on the surface, the fluid sample may remain in fluid sampler 50 for a considerable time during which temperature conditions may fluctuate. Accordingly, surface pressure source 28 may be used to supercharge the fluid sample via the coiled tubing or preferably by a direct connection between pressure source 28 and fluid sampler 50.

Figure 5A:
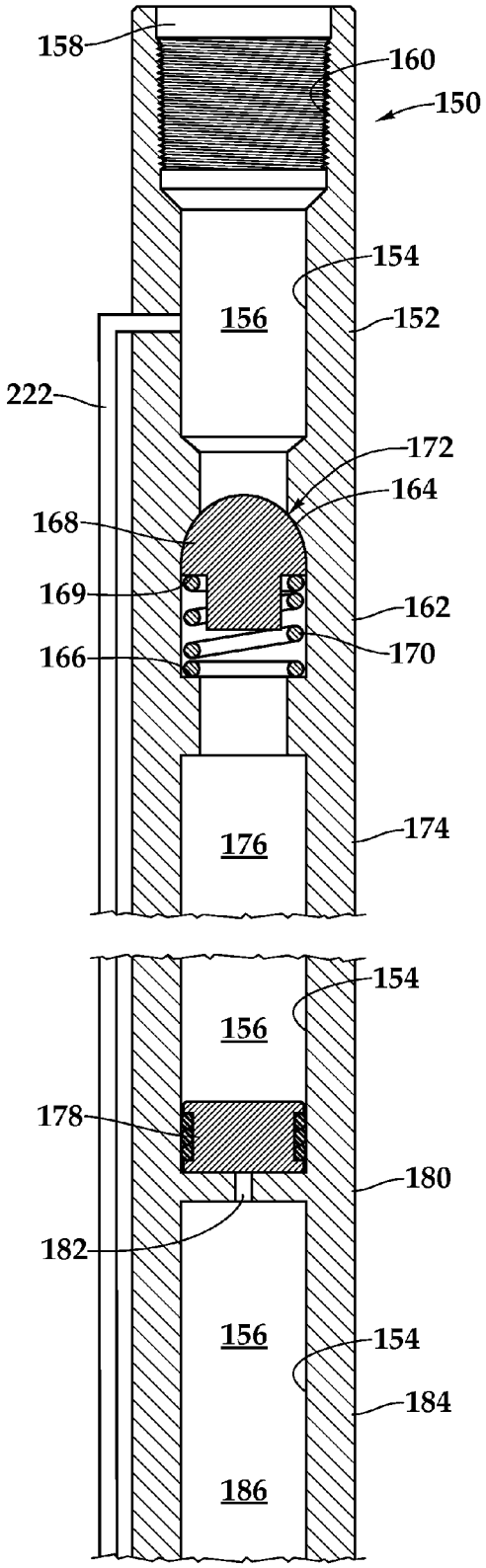
FIGS. 5A-5B are cross-sectional views of another embodiment of a fluid sampler embodying principles of the present invention in its running position.
Figure 5B:
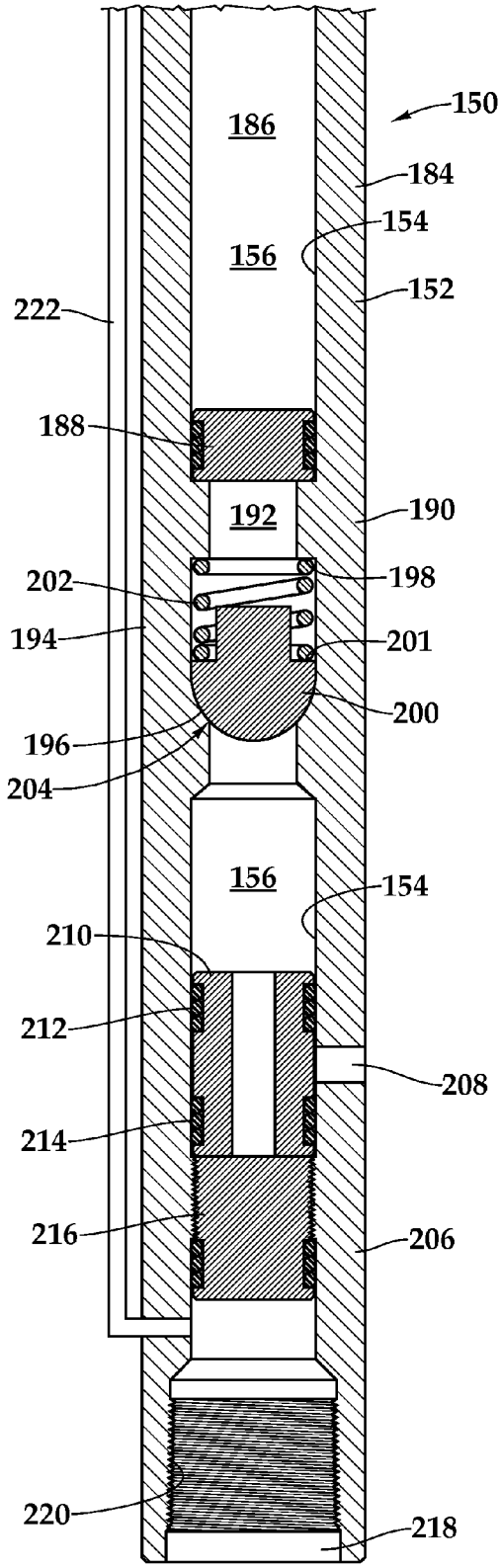

Referring now to FIGS. 5A-5B, a fluid sampler that embodies principles of the present invention is representatively illustrated and generally designated 150. Fluid sampler 150 is depicted in its initial or running configuration. Fluid sampler 150 includes an outer housing 152 having a bore 154 that defines an interior central housing passage 156 that extends longitudinally through fluid sampler 150. The uppermost section of outer housing 152 has an open end 158 including internal threads 160 defined therein for connection of fluid sampler 150 to coiled tubing string 24, a similar fluid sampler or other tool in a conventional manner. When coiled tubing string is connected to fluid sampler 150, the tubing bore of coiled tubing string 24 will be in fluid communication with interior passage 156 of fluid sampler 150.

Outer housing 152 includes an upper valve housing section 162. Upper valve housing section 162 has a valve seat 164 and an upwardly facing shoulder 166. Disposed within central housing passage 156 and upper valve housing section 162 is a valve element 168 having a downwardly facing shoulder 169. A biasing element depicted as a spiral wound compression spring 170 is positioned between upwardly facing shoulder 166 and downwardly facing shoulder 169. In this configuration, spring 170 biases valve element 168 against valve seat 164 which prevents fluid flow upwardly through upper valve housing section 162, however, differential pressure of a predetermined magnitude sufficient to overcome the spring force of spring 170 shifts valve element 168 off valve seat 164, which allows fluid flow downwardly through upper valve housing section 162. As such, valve seat 164, valve element 168 and spring 170 operate as a one-way valve and may be referred to collectively as check valve 172.

Below upper valve housing section 162, outer housing 152 includes an atmospheric and charging housing section 174. The portion of central housing passage 156 disposed within atmospheric and charging housing section 174 is also referred to herein as atmospheric and charging chamber 176. Defining the lower end of atmospheric and charging chamber 176 is an optional floating piston 178 which is slidingly and sealable disposed within bore 154 of housing 152. Outer housing 152 includes a flow restrictor housing section 180. Positioned within central housing passage 156 and flow restrictor housing section 180 is a flow restricting device depicted as orifice 182.

Below flow restrictor housing section 180, outer housing 152 includes a metering fluid housing section 184. The portion of central housing passage 156 disposed within metering fluid housing section 184 is also referred to herein as a metering fluid chamber 186. Defining the lower end of metering fluid chamber 186 is a floating piston 188 which is slidingly and sealable disposed within bore 154 of housing 152. The upper end of metering fluid chamber 176 is defined by floating piston 178. Below metering fluid housing section 184, outer housing 152 includes a sample fluid housing section 190. The portion of central housing passage 156 disposed within sample fluid housing section 190 is also referred to herein as a sample fluid chamber 192. The upper end of sample fluid chamber 192 is defined by floating piston 188.

Outer housing 152 also includes a lower valve housing section 194. Lower valve housing section 194 has a valve seat 196 and a downwardly facing shoulder 198. Disposed within central housing passage 156 and lower valve housing section 194 is a valve element 200 having an upwardly facing shoulder 201. A biasing element depicted as a spiral wound compression spring 202 is positioned between downwardly facing shoulder 198 and upwardly facing shoulder 201. In this configuration, spring 202 biases valve element 200 against valve seat 196 which prevents fluid flow downwardly through lower valve housing section 194, however, differential pressure of a predetermined magnitude sufficient to overcome the spring force of spring 202 shifts valve element 200 off valve seat 196, which allows fluid flow upwardly through lower valve housing section 194. As such, valve seat 196, valve element 200 and spring 202 operate as a one-way valve and may be referred to collectively as check valve 204.

Below lower valve housing section 194, outer housing 152 includes a sample fluid entry housing section 206. Sample fluid entry housing section 206 includes one or more openings 208 that provide fluid communication between the exterior of fluid sampler 150 and central housing passage 156. Disposed within fluid entry housing section 206 and central housing passage 156 is a sliding sleeve 210. In the running position depicted in FIGS. 5A-5B, seals 212 and 214 straddle opening 208 and prevent fluid communication between the exterior of fluid sampler 150 and central housing passage 156. Also disposed within fluid entry housing section 206 and central housing passage 156 is an actuator 216 that is operable to shift sliding sleeve 210 such that seals 212 and 214 no longer straddle opening 208 to allow fluid communication between the exterior of fluid sampler 150 and central housing passage 156.

The lowermost section of outer housing 152 has an open end 218 including internal threads 220 defined therein for connection of fluid sampler 150 another tool either similar to or different from fluid sampler 150 or to receive a plug therein. When fluid sampler 150 is connected to a similar fluid sampler, central housing passage 156 of fluid sampler 150 will be in fluid communication with a similar interior passage of the similar fluid sampler.

The primary difference between fluid sampler 150 and fluid sampler 50 is that fluid sampler 150 is designed to work in tandem with other similar fluid samplers. Specifically, fluid sampler 150 incorporates a bypass conduit 222 that provide fluid communication between the uppermost portion of central housing passage 156 above check valve 172 and the lowermost portion of central housing passage 156 below actuator 216. Using this design, when multiple fluid samplers 150 are coupled together, the lowermost portion of central housing passage 156 of one fluid sampler 150 is in fluid communication with the uppermost portion of central housing passage 156 of the next lower fluid sampler 150. Accordingly, bypass conduit 222 allows fluid communication from each fluid sampler 150 to the next.

In operation, a fluid sample is obtained in each of the fluid samplers 150 in a manner similar to that described above with reference to fluid sampler 50. Specifically, once each fluid sampler 150 is redressed, coupled within coiled tubing string 24 and lower to the desired location, actuator 216 operates sliding sleeve 210 to allow fluid communication between the exterior of fluid sampler 150 and central housing passage 156 via opening 208. The high pressure formation fluids then enter central housing passage 156 and are permitted to flow into sample fluid chamber 192 by shifting valve element 200 off valve seat 196. The formation fluids act against the lower side of floating piston 188 which causes floating piston 188 to move in the upward direction. The metering of fluid through orifice 182 controls the velocity at which floating piston 188 moves, thereby controlling the sampling period for obtaining a fluid sample into sample fluid chamber 192.

Once a fluid sample has been obtained in each of the fluid samplers 150, either simultaneously or in series, high pressure nitrogen is communicated to each fluid sampler 150 via the tubing bore of coiled tubing string 24 and the respective bypass conduits 222. In each fluid sampler 150, the high pressure nitrogen acts on valve element 168 which shifts valve element 168 off seat allowing the high pressure nitrogen to pass downwardly through upper valve housing section 162. The high pressure nitrogen then acts on the upper side of floating piston 178 which forces the metering fluid back through orifice 182, which in turn allows the metering fluid to act on the upper side of floating piston 188. As floating piston 188 shifts downwardly and as valve element 200 remains seated on valve seat 196, the fluid sample in each of the sample fluid chambers 192 is pressurized. Once the charging process in complete, the pressure within the tubing bore of coiled tubing string 24 and the respective bypass conduits 222 may be bled off such that in each fluid sampler 150, valve element 168 reseats on valve seat 164, trapping the higher pressure nitrogen in atmospheric and charging chamber 176. As fluid samplers 150 are retrieved to the surface, the retrieval process can be stopped at any time and from time to time to recharge the fluid samples by again pressurizing the tubing bore of coiled tubing string 24 and bypass conduits 222 with high pressure nitrogen at the desired pressure. Once on the surface, fluid samplers 150 may remain coupled together or may be separated from one another. If desired, the fluid samples in each fluid sampler 150 may be supercharge via the coiled tubing or preferably by a direct connection between pressure source 28 and fluid sampler 150.

Figure 6A:
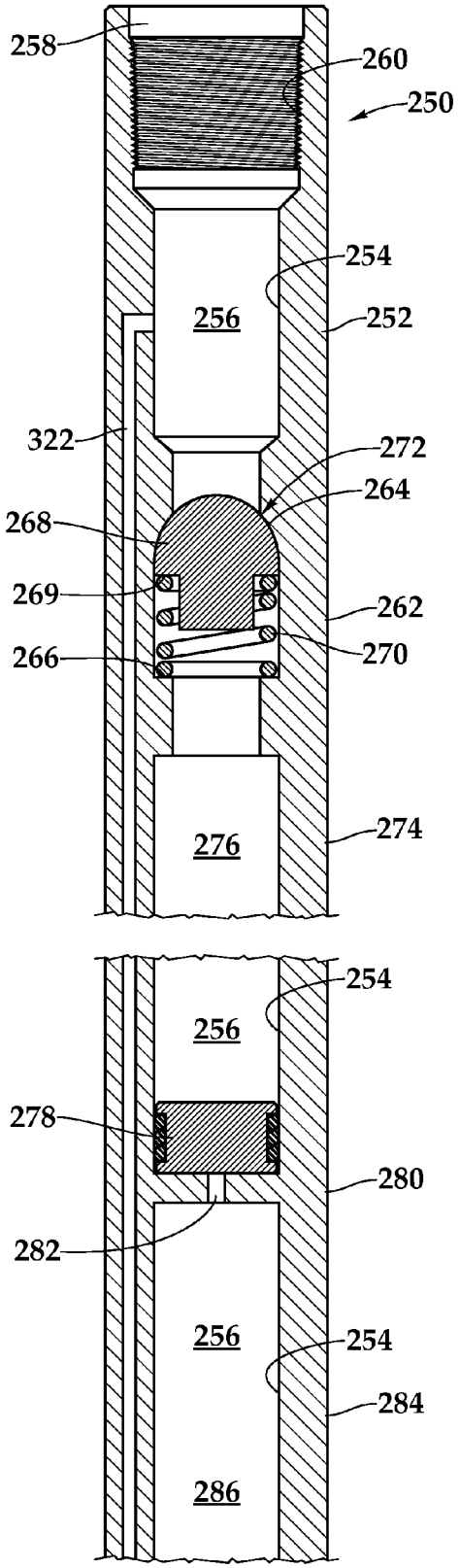
FIGS. 6A-6B are cross-sectional views of a further embodiment of a fluid sampler embodying principles of the present invention in its running position.
Figure 6B:
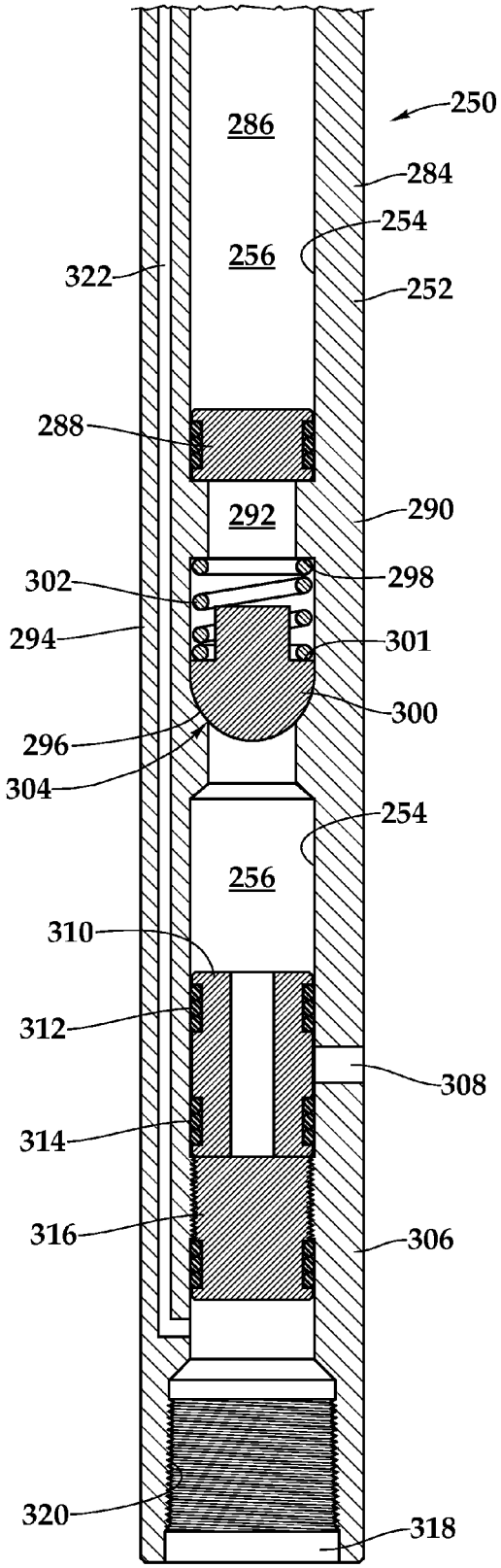

Referring now to FIGS. 6A-6B, a fluid sampler that embodies principles of the present invention is representatively illustrated and generally designated 250. Fluid sampler 250 is depicted in its initial or running configuration. Fluid sampler 250 includes an outer housing 252 having a bore 254 that defines an interior central housing passage 256 that extends longitudinally through fluid sampler 250. The uppermost section of outer housing 252 has an open end 258 including internal threads 260 defined therein for connection of fluid sampler 250 to coiled tubing string 24, a similar fluid sampler or other tool in a conventional manner. When coiled tubing string is connected to fluid sampler 250, the tubing bore of coiled tubing string 24 will be in fluid communication with interior passage 256 of fluid sampler 250.

Outer housing 252 includes an upper valve housing section 262. Upper valve housing section 262 has a valve seat 264 and an upwardly facing shoulder 266. Disposed within central housing passage 256 and upper valve housing section 262 is a valve element 268 having a downwardly facing shoulder 269. A biasing element depicted as a spiral wound compression spring 270 is positioned between upwardly facing shoulder 266 and downwardly facing shoulder 269. In this configuration, spring 270 biases valve element 268 against valve seat 264 which prevents fluid flow upwardly through upper valve housing section 262, however, differential pressure of a predetermined magnitude sufficient to overcome the spring force of spring 270 shifts valve element 268 off valve seat 264, which allows fluid flow downwardly through upper valve housing section 262. As such, valve seat 264, valve element 268 and spring 270 operate as a one-way valve and may be referred to collectively as check valve 272.

Below upper valve housing section 262, outer housing 252 includes an atmospheric and charging housing section 274. The portion of central housing passage 256 disposed within atmospheric and charging housing section 274 is also referred to herein as atmospheric and charging chamber 276. Defining the lower end of atmospheric and charging chamber 276 is an optional floating piston 278 which is slidingly and sealable disposed within bore 254 of housing 252. Outer housing 252 includes a flow restrictor housing section 280. Positioned within central housing passage 256 and flow restrictor housing section 280 is a flow restricting device depicted as orifice 282.

Below flow restrictor housing section 280, outer housing 252 includes a metering fluid housing section 284. The portion of central housing passage 256 disposed within metering fluid housing section 284 is also referred to herein as a metering fluid chamber 286. Defining the lower end of metering fluid chamber 286 is a floating piston 288 which is slidingly and sealable disposed within bore 254 of housing 252. The upper end of metering fluid chamber 276 is defined by floating piston 278. Below metering fluid housing section 284, outer housing 252 includes a sample fluid housing section 290. The portion of central housing passage 256 disposed within sample fluid housing section 290 is also referred to herein as a sample fluid chamber 292. The upper end of sample fluid chamber 292 is defined by floating piston 288.

Outer housing 252 also includes a lower valve housing section 294. Lower valve housing section 294 has a valve seat 296 and a downwardly facing shoulder 298. Disposed within central housing passage 256 and lower valve housing section 294 is a valve element 300 having an upwardly facing shoulder 301. A biasing element depicted as a spiral wound compression spring 302 is positioned between downwardly facing shoulder 298 and upwardly facing shoulder 301. In this configuration, spring 302 biases valve element 300 against valve seat 296 which prevents fluid flow downwardly through lower valve housing section 294, however, differential pressure of a predetermined magnitude sufficient to overcome the spring force of spring 302 shifts valve element 300 off valve seat 296, which allows fluid flow upwardly through lower valve housing section 294. As such, valve seat 296, valve element 300 and spring 302 operate as a one-way valve and may be referred to collectively as check valve 304.

Below lower valve housing section 294, outer housing 252 includes a sample fluid entry housing section 306. Sample fluid entry housing section 306 includes one or more openings 308 that provide fluid communication between the exterior of fluid sampler 250 and central housing passage 256. Disposed within fluid entry housing section 306 and central housing passage 256 is a sliding sleeve 310. In the running position depicted in FIGS. 6A-6B, seals 312 and 314 straddle opening 308 and prevent fluid communication between the exterior of fluid sampler 250 and central housing passage 256. Also disposed within fluid entry housing section 306 and central housing passage 256 is an actuator 316 that is operable to shift sliding sleeve 310 such that seals 312 and 314 no longer straddle opening 308 to allow fluid communication between the exterior of fluid sampler 250 and central housing passage 256.

The lowermost section of outer housing 252 has an open end 318 including internal threads 320 defined therein for connection of fluid sampler 250 another tool either similar to or different from fluid sampler 250 or to receive a plug therein. When fluid sampler 250 is connected to a similar fluid sampler, central housing passage 256 of fluid sampler 250 will be in fluid communication with a similar interior passage of the similar fluid sampler.

Similar to fluid sampler 150 and fluid sampler 250 is designed to work in tandem with other similar fluid samplers. Specifically, fluid sampler 250 incorporates an internal bypass passageway 322 that provide fluid communication between the uppermost portion of central housing passage 256 above check valve 272 with the lowermost portion of central housing passage 256 below actuator 316. Using this design, when multiple fluid samplers 250 are coupled together, the lowermost portion of central housing passage 256 of one fluid sampler 250 is in fluid communication with the uppermost portion of central housing passage 256 of the next lower fluid sampler 250. Accordingly, internal bypass passageway 322 allows fluid communication from each fluid sampler 250 to the next.

In operation, a fluid sample is obtained in each of the fluid samplers 250 in a manner similar to that described above with reference to fluid sampler 50. Specifically, once each fluid sampler 250 is redressed, coupled within coiled tubing string 24 and lower to the desired location, actuator 316 operates sliding sleeve 310 to allow fluid communication between the exterior of fluid sampler 250 and central housing passage 256 via opening 308. The high pressure formation fluids then enter central housing passage 256 and are permitted to flow into sample fluid chamber 292 by shifting valve element 300 off valve seat 296. The formation fluids act against the lower side of floating piston 288 which causes floating piston 288 to move in the upward direction. The metering of fluid through orifice 282 controls the velocity at which floating piston 288 moves, thereby controlling the sampling period for obtaining a fluid sample into sample fluid chamber 292.

Once a fluid sample has been obtained in each of the fluid samplers 250, either simultaneously or in series, high pressure nitrogen is communicated to each fluid sampler 250 via the tubing bore of coiled tubing string 24 and the respective internal bypass passageways 322. In each fluid sampler 250, the high pressure nitrogen acts on valve element 268 which shifts valve element 268 off seat allowing the high pressure nitrogen to pass downwardly through upper valve housing section 262. The high pressure nitrogen then acts on the upper side of floating piston 278 which forces the metering fluid back through orifice 282, which in turn allows the metering fluid to act on the upper side of floating piston 288. As floating piston 288 shifts downwardly and as valve element 300 remains seated on valve seat 296, the fluid sample in each of the sample fluid chambers 292 is pressurized. Once the charging process in complete, the pressure within the tubing bore of coiled tubing string 24 and the respective internal bypass passageways 322 may be bled off such that in each fluid sampler 250, valve element 268 reseats on valve seat 264, trapping the higher pressure nitrogen in atmospheric and charging chamber 276. As fluid samplers 250 are retrieved to the surface, the retrieval process can be stopped at any time and from time to time to recharge the fluid samples by again pressurizing the tubing bore of coiled tubing string 24 and internal bypass passageways 322 with high pressure nitrogen at the desired pressure. Once on the surface, fluid samplers 250 may remain coupled together or may be separated from one another. If desired, the fluid samples in each fluid sampler 250 may be supercharge via the coiled tubing or preferably by a direct connection between pressure source 28 and fluid sampler 250.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method of collecting a single phase fluid sample from a well extending below a surface of the earth, the method comprising:

running a fluid sampler into the well on a coiled tubing string by deploying a continuous pipe string from a coiled tubing reel, the fluid sampler including a longitudinally extending central passageway defining a charging chamber, a metering fluid chamber and a sample fluid chamber;

actuating the fluid sampler to establish fluid communication between the sample fluid chamber and an exterior of the fluid sampler;

obtaining a fluid sample from the well in the sample fluid chamber at a controlled rate by metering a fluid through a restriction in the metering fluid chamber;

increasing fluid pressure in the coiled tubing string using a pressure source located above the surface of the earth to pressurize fluid in the charging chamber;

pressurizing the fluid sample in response to increasing fluid pressure in the charging chamber; and retrieving the coiled tubing and the fluid sampler containing the fluid sample from the well.

2. The method as recited in claim 1 wherein actuating the fluid sampler further comprises shifting a sliding sleeve.

3. The method as recited in claim 1 wherein obtaining a fluid sample further comprises flowing the fluid sample through a one-way valve in the fluid sampler.

4. The method as recited in claim 1 wherein obtaining a fluid sample further comprises shifting a floating piston and expanding the sample fluid chamber.

5. The method as recited in claim 4 wherein shifting a floating piston further comprises passing a metering fluid through a restrictor.

6. The method as recited in claim 5 wherein passing a metering fluid through a restrictor further comprises passing the metering fluid through an orifice.

7. The method as recited in claim 1 wherein pressurizing the fluid sample further comprises communicating fluid pressure from the coiled tubing string through a one-way valve in the fluid sampler.

8. The method as recited in claim 1 wherein retrieving the coiled tubing and the fluid sampler further comprises repressurizing the fluid sample in the sample fluid chamber in response to increasing fluid pressure in the coiled tubing string.

9. A system for collecting a single phase fluid sample from a well extending below a surface of the earth, the system comprising:

a coiled tubing string having a tubing bore, the coiled tubing string comprising a continuous pipe string deployed from a coiled tubing reel;

a housing connected to the coiled tubing string, the housing including an opening and a longitudinally extending passageway disposed centrally within the housing that includes a charging chamber, a metering fluid chamber and a sample fluid chamber;

an actuator disposed within the housing, the actuator operable to establish fluid communication between the sample fluid chamber and an exterior of the housing through the opening;

a first one-way valve disposed within the passageway that defines a first end of the sample fluid chamber;

a first floating piston disposed within the passageway that defines a second end of the sample fluid chamber and a first end of the metering fluid chamber;

a second floating piston disposed within the passageway that defines a second end of the metering fluid chamber and a first end of the charging chamber;

a second one-way valve disposed within the passageway that defines a second end of the charging chamber;

a pressure source located above the surface of the earth that is selectively in fluid communication with the charging chamber through the tubing bore and the second one-way valve; and a restrictor disposed within the passageway between the first and second floating pistons.

10. The system as recited in claim 9 wherein, upon the actuator establishing fluid communication between the sample fluid chamber and the exterior of the housing through the opening, a fluid sample from the well enters the sample fluid chamber, the fluid sample passing through the first one-way valve and acting on the first floating piston to expand the sample fluid chamber.

11. The system as recited in claim 10 wherein a metering fluid in the metering fluid chamber passes through the restrictor in response to the fluid sample acting on the first floating piston, the metering fluid controlling the rate of expansion of the sample fluid chamber.

12. The system as recited in claim 11 wherein the metering fluid acts on the second floating piston to contract the charging chamber.

13. The system as recited in claim 11 wherein, upon completing the capture of the fluid sample in the sample fluid chamber, fluid pressure in the tubing bore of the coiled tubing string is increased such that the fluid pressure passes through the second one-way valve and acts on the second floating piston to expand the charging chamber and force metering fluid through the restrictor, the metering fluid acting on the first floating piston to contract the sample fluid chamber, thereby pressurizing the fluid sample in the sample fluid chamber.

14. A method of collecting a single phase fluid sample from a subterranean well, the method comprising:

running a fluid sampler into the well on a coiled tubing string;

actuating the fluid sampler to establish fluid communication between a sample chamber and an exterior of the fluid sampler to obtain a fluid sample;

passing the fluid sample through a first one-way valve;

expanding the sample fluid chamber by shifting a first floating piston responsive to fluid sample pressure;

controlling an expansion rate of the sample fluid chamber by restricting flow of a metering fluid in a metering fluid chamber;

contracting a charging chamber by shifting a second floating piston toward a second one-way valve responsive to metering fluid pressure;

communicating fluid pressure through the second one-way valve and shifting the second floating piston to expand the charging chamber by increasing the fluid pressure in the coiled tubing string;

shifting the first floating piston to contract the sample fluid chamber responsive to metering fluid pressure; and pressurizing the fluid sample in the sample fluid chamber.

15. The method as recited in claim 14 wherein controlling the expansion rate of the sample fluid chamber by restricting flow of the metering fluid further comprises maintaining the pressure of the fluid sample above a saturation pressure of the fluid sample.

16. The method as recited in claim 15 further comprising retrieving the coiled tubing and the fluid sampler containing the fluid sample from the well and maintaining the pressure of the fluid sample above the saturation pressure of the fluid sample during the retrieving step.

17. The method as recited in claim 16 wherein maintaining the pressure of the fluid sample above the saturation pressure of the fluid sample during the retrieving step further comprises repressurizing the fluid sample in the chamber by further increasing fluid pressure in the coiled tubing string.

18. The method as recited in claim 16 wherein maintaining the pressure of the fluid sample above the saturation pressure of the fluid sample during the retrieving step further comprises maintaining the pressure of the fluid sample above reservoir pressure.

19. The method as recited in claim 16 wherein maintaining the pressure of the fluid sample above the saturation pressure of the fluid sample during the retrieving step further comprises maintaining the pressure of the fluid sample between about 2,000 psi and 7,000 psi above reservoir pressure.

* * * * *